US007956557B1

(12) United States Patent
Waterman

(10) Patent No.: US 7,956,557 B1
(45) Date of Patent: Jun. 7, 2011

(54) SUPPORT STRUCTURES FOR PLANAR INSERTION DEVICES

(75) Inventor: David John Waterman, Dryden, NY (US)

(73) Assignee: Advanced Design Consulting USA, Inc., Lansing, NY (US)

( * ) Notice: Subject to any disclaimer, the term of this patent is extended or adjusted under 35 U.S.C. 154(b) by 511 days.

(21) Appl. No.: 12/207,519

(22) Filed: Sep. 10, 2008

Related U.S. Application Data

(60) Provisional application No. 60/971,561, filed on Sep. 11, 2007.

(51) Int. Cl.
*H05H 11/00* (2006.01)
*H05H 7/00* (2006.01)

(52) U.S. Cl. ..... 315/503; 315/501

(58) Field of Classification Search ..... 315/500, 315/501, 502, 503, 504, 505; 250/493.1, 250/494.1, 495.1, 496.1
See application file for complete search history.

(56) References Cited

U.S. PATENT DOCUMENTS 5,383,049 A 1/1995 Carr
5,483,077 A * 1/1996 Glavish ..... 250/492.2
5,714,850 A 2/1998 Kitamura
6,057,656 A 5/2000 Ohashi
6,615,467 B1 9/2003 Richards
6,858,998 B1 * 2/2005 Shenoy et al. ..... 315/503
7,019,522 B1 * 3/2006 Johnson et al. ..... 324/260
2006/0265859 A1 11/2006 Lanni

OTHER PUBLICATIONS

J. Bahrdt, Apple Undulators for HGHG-FELS, Proceedings of FEL 2006, 28th International Free Electron Laser Conference, paper No. THBAU01, pp. 521-528, BESSY, Berlin, Germany.

* cited by examiner

*Primary Examiner* — Douglas W Owens
*Assistant Examiner* — Minh D A
(74) *Attorney, Agent, or Firm* — Leo B. Kriksunov

(57) ABSTRACT

A planar insertion device and supporting structure for a planar insertion device for treating a synchrotron radiation beam includes a primary frame on which at least two secondary C-frames are mounted. An upper and a lower girders are mounted on the secondary C-frames forming a gap between girders and arranged substantially horizontally and parallel to each other and to the synchrotron radiation beam. Magnetic arrays rigidly mounted on the girders are facing each other and facing the gap between girders, with the synchrotron radiation beam passing between the magnetic arrays through the gap. The planar insertion device supporting structure prevents detrimental deformation reactions to variations of magnetic loadings with changes in the gap and subsequent geometrical misalignments.

20 Claims, 14 Drawing Sheets

A

B

SUPPORT STRUCTURES FOR PLANAR INSERTION DEVICES

This application claims the benefit of U.S. Provisional Application No. 60/971,561, filed Sep. 11, 2007.

TECHNICAL FIELD

The invention relates to insertion devices for use with synchrotron radiation and more particularly to supporting structures for insertion devices, providing for reduced unwanted movements and deformations of the horizontal girders supporting magnet arrays treating a synchrotron particle beam.

BACKGROUND

Insertion devices (ID's) also known as undulators and wigglers are used in second and third generation synchrotrons and linear particle accelerators such as free electron laser facilities. Insertion devices are designed to hold and precisely position arrays of strong magnets in proximity to the particle beam and thereby produce brilliant x-rays that are used for a broad range of scientific experiments. There are specific tolerance requirements for magnet array positioning for each insertion device, depending on parameters of the particular synchrotron or linear accelerator in which the device will be used, and also on parameters of the x-rays required for the particular scientific experiments planned using the x-ray light to be produced. Magnetic force levels contained in insertion devices can range into the hundreds of kilonewtons while magnet array positioning accuracy requirement tolerances can be as little as ±1 micrometer.

Insertion devices are produced in two basic types, usually defined as planar or polarizing. The planar devices employ magnet arrays in an arrangement spatially constrained by the insertion device in a manner that produces only vertical attractive magnetic forces between the magnet arrays, as the insertion device drives the horizontally oriented girders so as to vertically translate the magnet arrays in close proximity above and below the particle beam. Polarizing insertion devices are more complex devices capable of moving the magnet arrays longitudinally as well as vertically and they see additional forces including repulsive vertical, and also transverse and longitudinal forces.

Very mechanically stiff structures are used to meet these requirements. The historical trend is towards stronger magnetic forces due to improved magnet materials, longer magnet arrays, and smaller gaps used between magnet arrays, while the positioning accuracy tolerances for the magnet arrays have become tighter in the newest generation synchrotrons and even tighter in free electron lasers. These trends challenge the existing mechanical support and drive systems configurations for the insertion devices. There is a need to significantly reduce detrimental modes of magnet array misalignments that occur under magnetic loading in the currently known insertion devices support frames.

BRIEF DESCRIPTION

Briefly, according to an embodiment of the present invention, a planar insertion device and supporting structure for a planar insertion device for treating a synchrotron particle beam to create a desired x-ray beam include a primary frame on which at least two secondary C-frames are mounted. An upper and a lower girders are mounted on the primary C-frame forming a gap between girders which are arranged substantially horizontally and parallel to each other and to the synchrotron particle beam. The secondary C-frames are attached to the girders, serving to shunt detrimental forces to keep them from deforming the primary C-frame. Magnetic arrays rigidly mounted on the girders are facing each other and facing the gap between girders, with the synchrotron particle beam passing between the magnetic arrays through the gap. The planar insertion device supporting structure prevents detrimental deformation reactions to variations of magnetic loadings with changes in the gap and subsequent geometrical misalignments.

DETAILED DESCRIPTION

Orientation Terms Used

Longitudinal direction refers to a direction parallel to the theoretical centerline of the synchrotron or linear accelerator particle beam. For practical reasons, the particle beam generally runs horizontally. Transverse direction refers to a direction orthogonally transverse to the particle beam and also horizontal. The remaining orthogonal direction is vertical.

In describing rotations, roll means a rotation about a horizontal axis parallel to the particle beam. Pitch means rotation about a horizontal axis transverse to the particle beam. Yaw means a rotation about a vertical axis.

Planar Insertion Device Construction—Current Technology

Figure 1:
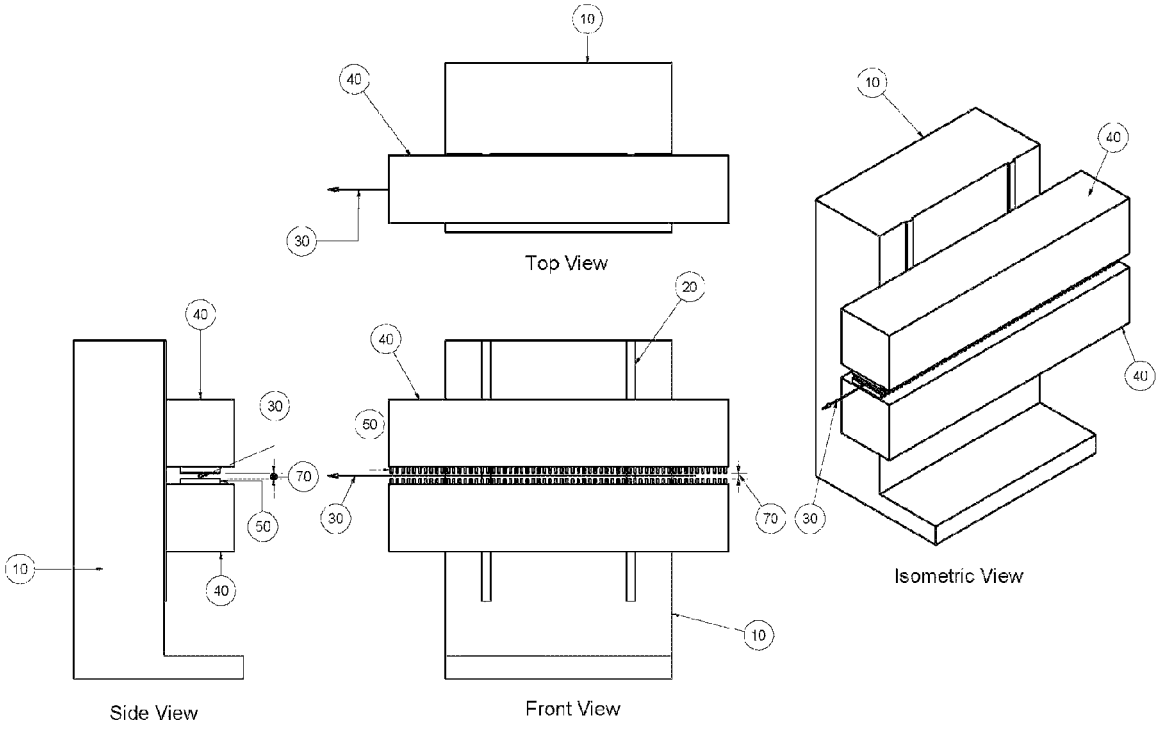
FIG. 1 shows schematics of a planar insertion device according to currently practiced technology.

Referring now to FIG. 1, a planar insertion device according to currently practiced technology is shown, with an insertion device frame (10) affixed to the floor. The frame 10 holds linear guidance assemblies such as rails or ways (20), in a vertical orientation, allowing the girders (40) to move in the vertical direction. At least two of the vertical rails or ways (20) are supporting girders (40) along the particle beam (30) for girder (40) stability.

Elongated horizontal girders (40) are positioned between longitudinally offset rails or ways (20) and are capable of moving on these rails or ways (20), typically positioned equidistant from the particle beam (30) at various vertical distances to produce variable required magnet gaps (70), typically by a controller driven by a specialized computer software. Positioning of the girders (40) is typically executed using one of various optional motorized drive assemblies (not shown). The drive assemblies may include ball screws, lead screws, roller screws, rack and pinion, or other common means for moving girders relative to a frame. The drive assemblies are also known as the gap drive, since they adjust the parameters of the gap (70) between the magnet arrays (50) in order to produce the intended x-rays for each particular scientific experiment. Two linear magnets arrays (50), with the arraying direction parallel to the particle beam (30), are affixed to the girders (40), with the magnet arrays (50) being directly opposite each other on the girder (40) surfaces facing toward the particle beam (30). The magnet arrays (50) attract with increasing magnetic force as the gap (70) is decreased.

Twelve Misalignment Modes of Insertion Device Girders

Misalignment of the girders (40) and the magnet arrays (50) which are supported by the girder (40) is detrimental to the correct functioning of the insertion devices because incorrectly positioned or misaligned magnets produce a distorted magnetic field applied to the particle beam (30). If the horizontal and vertical mid-plane of the magnetic field produced by the magnet arrays (50) is not coincident with the center line of the particle beam (30), or if the magnetic field is non-symmetric around the particle beam (30), or if the magnetic field intensity varies along the path of the particle beam (30) due to variations in the magnitude of the gap (70), then the particle beam (30) will be steered off the desired course. Such deviation of the particle beam is causing problems for the correct operation of the synchrotron or linear particle accelerator, and the x-rays produced by the particles passing through the magnetic fields will not meet required specifications for the scientific experiments being performed.

Accordingly, avoidance of girder (40) misalignments is a primary goal in design of insertion devices structures. A scientific article "APPLE UNDULATORS FOR HGHG-FELS" by J. Bahrdt, published in Proceedings of FEL 2006, 28th International Free Electron Laser Conference, BESSY, Berlin, Germany, THBAU01, pp. 521-528, which is incorporated herein by reference, highlights the extent of the concern for stiff structures for a particular Apple Undulator form of insertion device used in free electron lasers. Of note are FIGS. 12 and 13 in the cited article showing the use of a bionic optimization program to design a stiff support structure that is made from a single piece of cast iron. The structure described in the cited article is difficult to manufacture, expensive, and provides only limited access to the girders.

Figure 2:
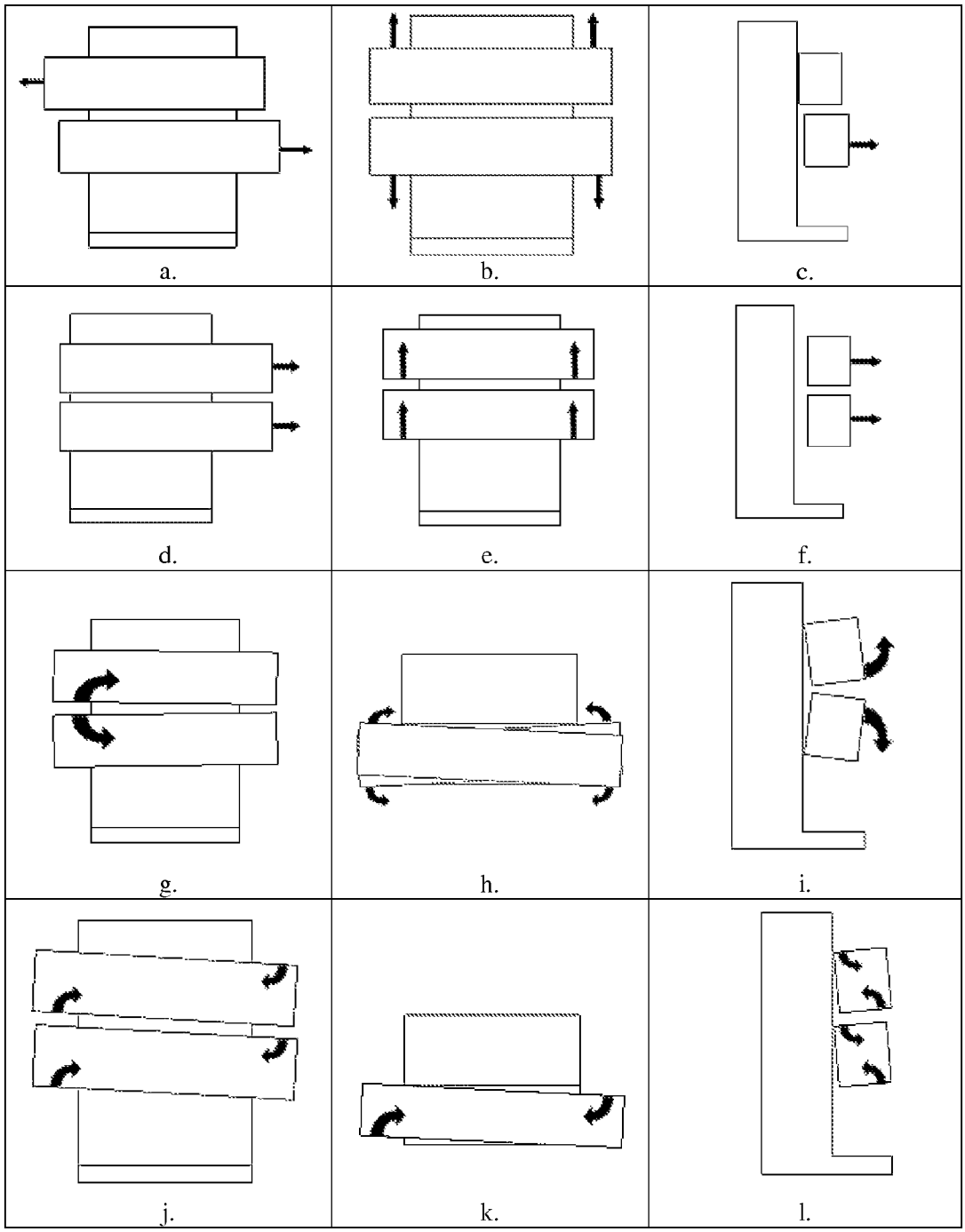
FIG. 2 schematically illustrates classification of girder misalignment modes.

Referring now to FIG. 2, the following classifications encompasses all twelve types geometrical misalignments of the insertion device girders:

a. Longitudinal displacement of upper vs. lower girder
b. Vertical displacement of upper vs. lower girder (gap change)
c. Transverse displacement of upper vs. lower girder.
d. Longitudinal displacement of both girders
e. Vertical displacement of both girders
f. Transverse displacement of both girders
g. Pitch of upper vs. lower girder
h. Yaw of upper vs. lower girder
i. Roll of upper vs. lower girder
j. Pitch of both girders in same direction
k. Yaw of both girders in same direction
l. Roll of both girders in same direction With reference to both FIG. 1 and FIG. 2, these twelve types or modes of misalignment combine to produce the total geometrical misalignment of the girders (40) and thereby the misalignment of the magnet arrays (50) and the magnetic field affecting the particle beam (30).

Figure 3:
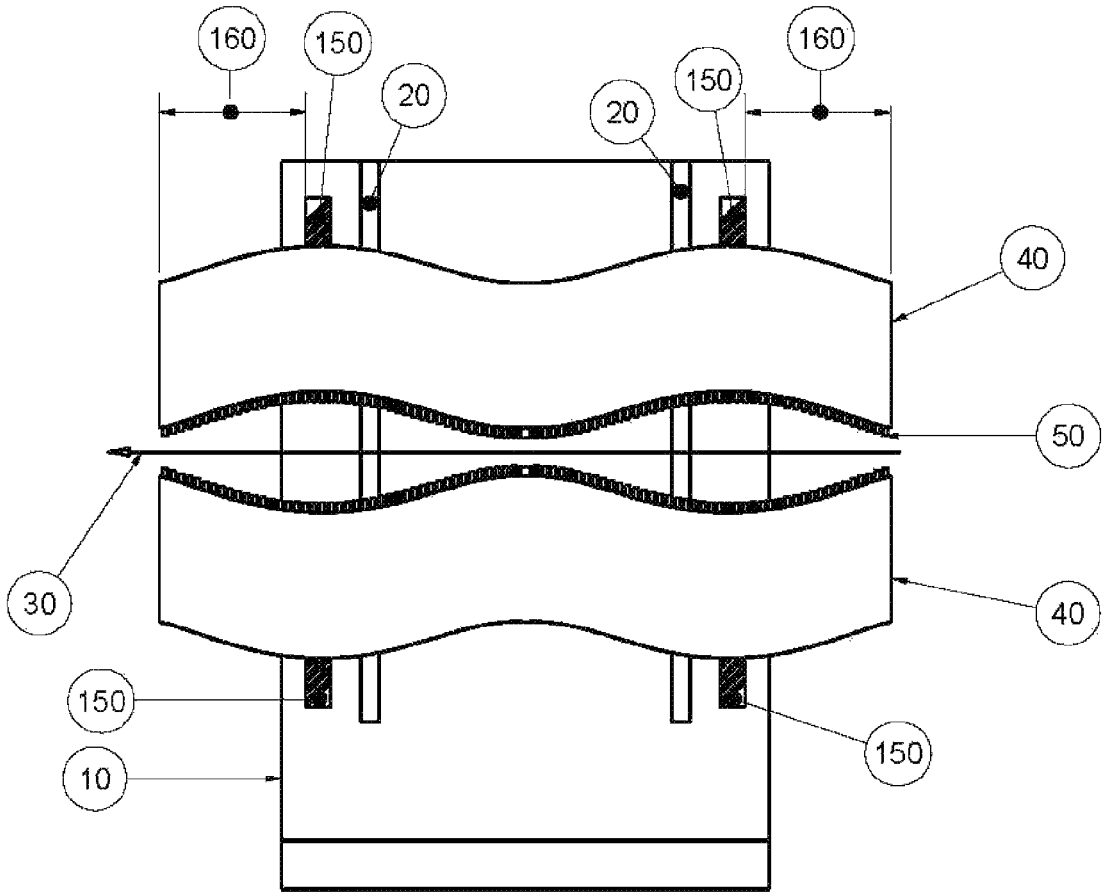
FIG. 3 schematically illustrates insertion device girder distortion.

In addition to the described geometric misalignment, distortion of the girders (40) themselves will cause the magnet arrays (50) to align in a non-linear fashion, thus distorting the magnetic fields. This distortion of the girders (40) should be preferably avoided in the design of the insertion devices. A typical mode for the most pronounced distortion of this type is shown in FIG. 3 intentionally exaggerated. This distortion of the girders (40) arises due to drive assemblies, such as ballscrews driven by stepper motors (150), acting at discrete locations, where attachment is made to girders (40), while magnetic attraction is distributed evenly along the entire magnet array (50).

Planar Insertion Device Support Structure Response to Varying Magnetic Attraction Since there is no resultant longitudinal component to the magnetic force in a planar type of insertion devices, symmetry of the supporting structure about a vertical plane at the center of the magnetic force, the mid-longitudinal plane of the magnet array (50), perpendicular to the particle beam (30), successfully prevents girder misalignments type a, d, g, h, j, and k (FIG. 2). Furthermore, misalignment type b is specifically addressed by the gap (70) drive system (not shown), and is thus presumably controlled by motors to a commanded position. The remaining misalignments types c, e, f, i, and l can all be depicted on the view of the support structure looking parallel to the particle beam (30)—such as in FIG. 1 "side view" of the insertion device. Thus symmetry in the currently practiced technology reduces the remaining problems of the geometrical misalignment of the girders in planar insertion devices to two dimensions.

Theoretically the insertion device frame can be designed so as to exploit symmetry of the structure about a vertical plane at the center of the particle beam (an "O" frame structure) and this would then control misalignments c, f, i, and l, leaving only misalignment e to control by other means, but this option is not typically used because of access limitations to the magnet arrays (50) and because it becomes topologically impossible to install the insertion device into a synchrotron ring without breaking the ring vacuum chamber through which the particle beam (30) travels, or alternatively dismantling the insertion device, so a traditional C-frame structure is used. The "C" is created by the imaginary combination of the primary frame (10) and the upper and lower girders (40). The same name is used for describing the frame structure of many items, such as for example drill presses, band saws and metal punches.

Girder Misalignments

Referring again to FIG. 1, one can attempt to exploit symmetry of the structure about a horizontal plane located at the center of the particle beam (30), in order to best ameliorate remaining girder (40) misalignments c, e, f, and l. To this end, girder (40) and supporting frame (10) dimensions and drive components are typically sized equally on upper and lower girders. However, a fundamental non-symmetry still exists in this primary C-frame structure (10), owing to the fact that the portion of C-frame structure (10) below the horizontal plane of the particle beam (30) is grounded to the floor, while the portion of C-frame structure (10) above this plane is attached only to the lower portion of the structure, and so its resulting geometrical movement is composed of a superposition of its deflections upon deflections of the lower supporting portion of the C-frame. Thus misalignment errors of the types c, e, f, i, and l remain extant in such design, and are only reduced to the extent that the structure can be made extremely stiff.

There is need to address this inherent non-symmetry in order to eliminate the remaining misalignment errors as identified above.

Figure 4:
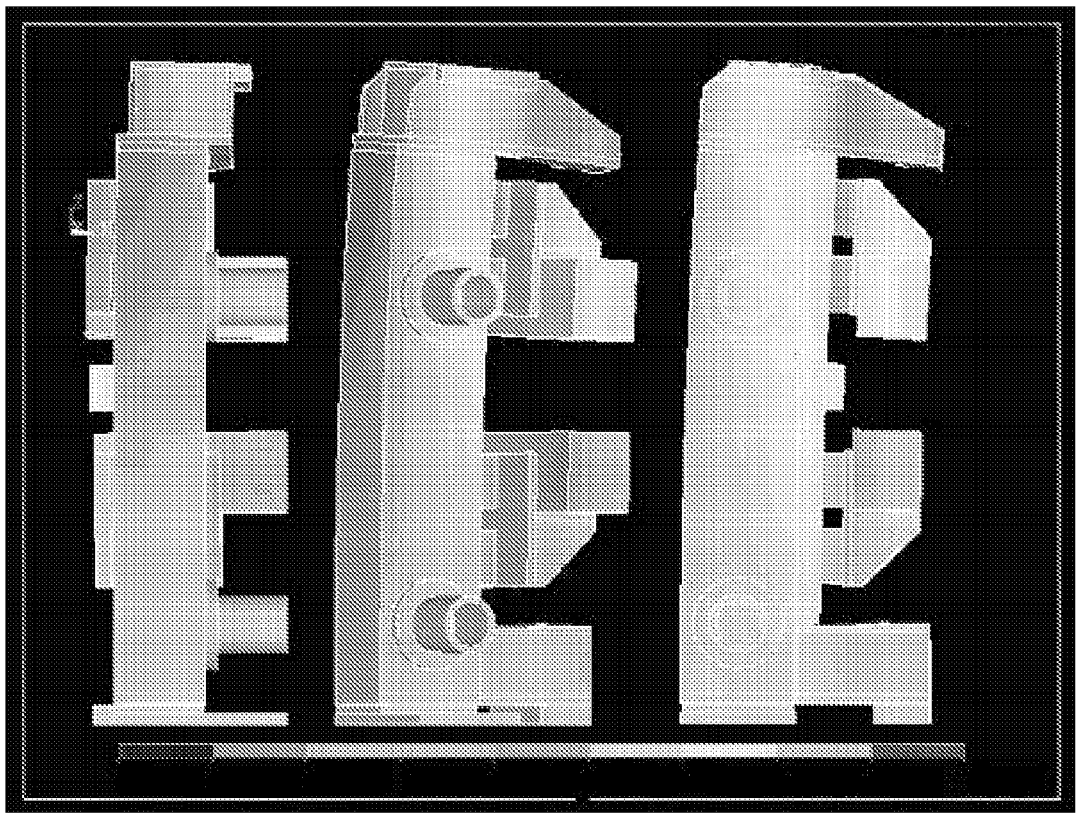
FIG. 4A shows finite element analysis of a planar insertion device.
FIG. 4B shows a graph of girder displacement.
Figure 4:
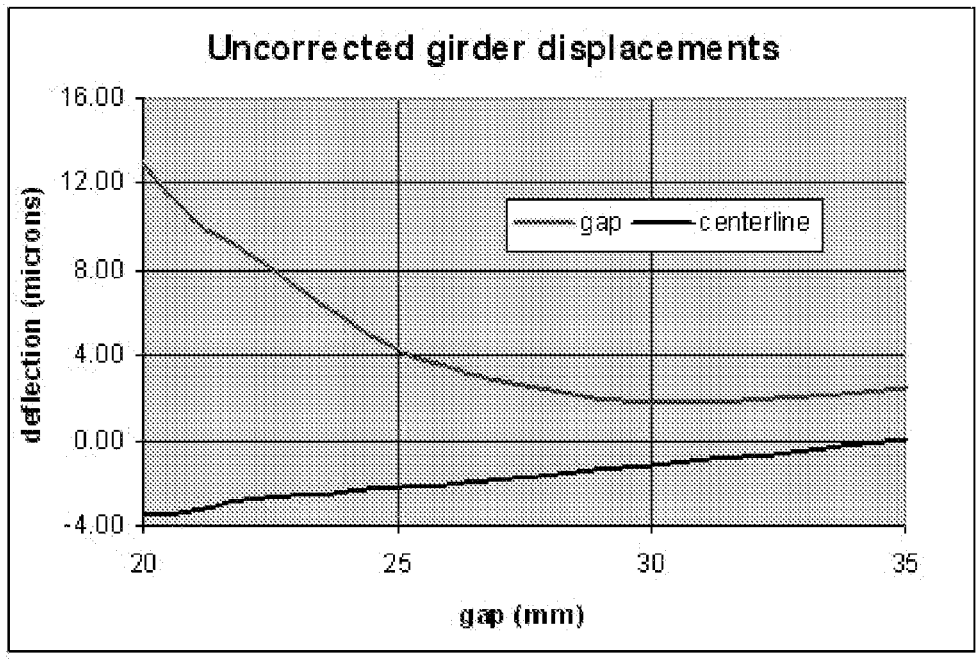

Referring now to FIG. 4A, an example of geometrical misalignments in existing art planar devices is shown as results of finite element analysis (FEA) of a planar insertion device. When the gap (70) between the magnet arrays (50) is varied, the device will deflect as seen in FIG. 4A. This deflection causes the magnet arrays (50) to no longer be symmetric in relation to the horizontal and vertical planes of the particle beam (30). The view is looking parallel to the particle beam (30), similar to "end view" in FIG. 1. We can see misalignments of types c, e, f, i, and l in the displayed results.

Referring now to FIG. 4B, the graph displays type b misalignment errors (gap 70 error) and type d misalignment errors (midplane vertical shift of the magnet arrays) plotted against commanded gap (70) for a planar insertion device, as predicted by a finite element analysis.

DETAILED DESCRIPTION OF EMBODIMENTS

Figure 5:
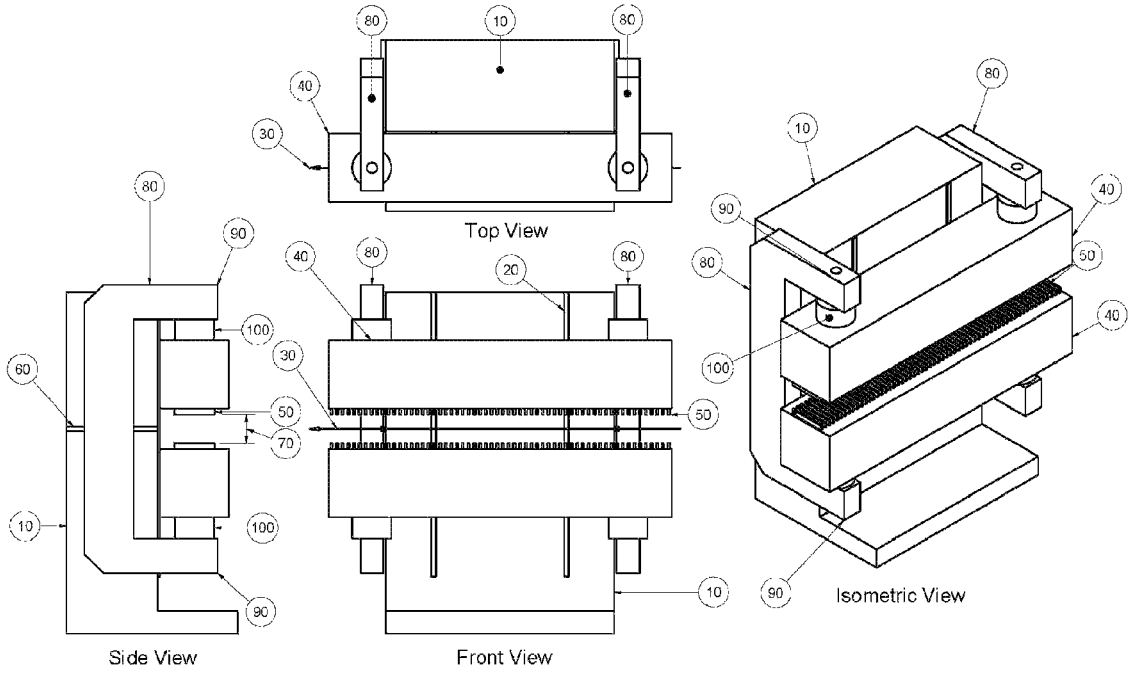
FIG. 5 shows an embodiment of the present invention.

Referring now to FIG. 5, an embodiment of the present invention is shown, with an insertion device having a primary frame (10) with vertically oriented linear bearing rails or ways (20), supporting horizontally oriented, vertically translating, substantially linear girders (40), to which are rigidly affixed arrays of magnets (50). There are two girders (40), including upper girder which is positioned above the beam (30) and lower girder which is positioned below the beam (30). At least two secondary C-frame structures (80), moveably fixed to the primary C-frame (10) at substantially the particle beam (30) height (which is also intentionally the magnetic field mid-plane) via horizontally oriented linear rails or ways (60), and having clearance at all other points. A gap (70) between magnet arrays (50) allows the particle beam (30) to pass through the insertion device and to be treated with the magnetic field formed by the magnet arrays (50).

Figure 14:
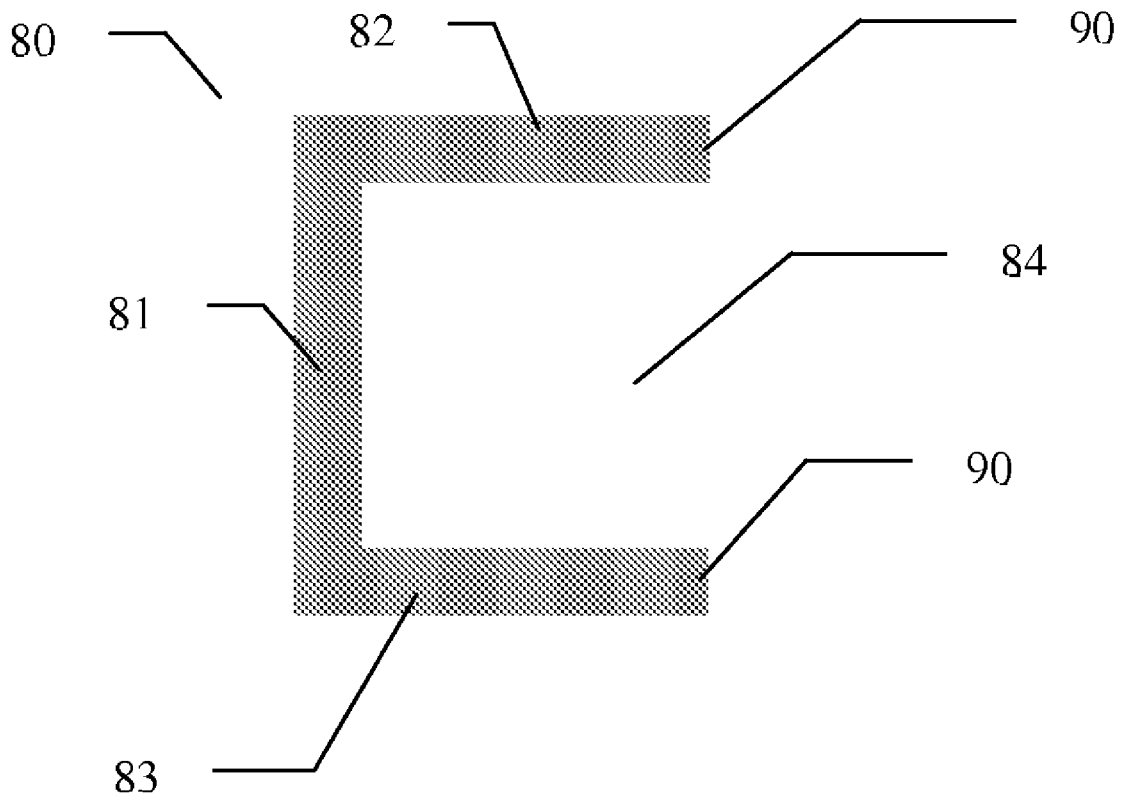
FIG. 14 shows a schematic cross-section of a secondary C-frame.

Referring now to FIG. 14, the secondary C-frames 80 have substantially similar geometry, formed generally in the shape of "C" with vertical portion 81 connecting an upper generally horizontal (or horizontally-extending) arm 82, and a lower generally horizontal (or horizontally extending) arm 83, and forming a throat 84. Horizontal arms 82 and 83 are vertically spaced and have terminal ends or tips 90 at the entrance to the throat 84. Terminal ends or tips 90 are spaced horizontally from vertical portion 81, with an imaginary straight line connecting the terminal ends or tips 90 being spaced from the vertical portion 81. The throat 84 is defined between the arms 82 and 83. Horizontal arms 82 and 83 are supporting upper and lower girders (40) (not shown in FIG. 14) which are positioned at least partially in the throat 84 and at least partially between the arms 82 and 83, with the upper girder mounted to the upper arm 82 and the lower girder being mounted to the lower arm 83. The vertical portion 81 is mounted to the primary frame (not shown in FIG. 14).

Referring again to FIG. 5, the tips 90 of the secondary C-frames 80 support girders 40 and magnet arrays 50 positioned on girders 40 via progressive spring assemblies 100, which will be described in more detail below.

The secondary C-frame (80) is used to contain the reactions to magnetic forces which vary with the symmetric vertical translations of the horizontal girders (40) to which the magnet arrays (50) are rigidly attached. This arrangement prevents the varying loads from being seen by the primary C-frame (10) structure that supports the insertion device and fixes it to the floor. Since the support to the floor no longer sees varying loads when the gap 70 is varied to produce x-rays with varying characteristics for scientific experimentation, the embodiment of the present invention does not exhibit movement of the magnetic field midplane seen in existing insertion devices support structures. The geometrical movements of the girders (40) and affixed magnet arrays (50) described as misalignments c, e, f, i, and l, can only be ameliorated by frame stiffness in the existing art, resulting in exceedingly costly and bulky structures. These misalignments are prevented in the current invention.

The secondary C-frame (80) can also be used to support other components such as vacuum pumps, for example, that will exert only relatively non-varying force into the structure. This might be done for assembly convenience further improving the utility of the embodiments of the present invention.

The planar insertion device support structure embodiments provide additional symmetry features used to control changes in misalignment errors c, e, f, i, and l that result from changes in magnetic attractive force as the gap (70) between the magnet arrays (50) is varied through the design specified range. At least two secondary C-frames (80) are mounted to the primary C-frame (10) of the insertion device that supports it to the floor. The secondary C-frame (80), unlike the primary C-frame (10), has true vertical symmetry about the horizontal plane of the particle beam (30). It is attached to the primary C-frame only at a location vertically coincident with the particle beam to maintain this symmetry.

Referring again to FIG. 5, a horizontal linear guide or way (60) at the attachment to the primary C-frame (10), allows free movement of the secondary C-frame (80) transversely to the particle beam (30). Thus the horizontal displacement of the tips (90) where attachment is made to the magnet array girders (40), due to variability of the vertical loading with changes in magnet gap (70) is addressed.

The transverse freedom is provided in order to keep the compensation spring assemblies (100) directly above and below the magnetic attractive forces. As magnetic loading force varies with gap (70) change, the secondary C-frame (80) distorts symmetric to its mount, thereby transmitting no varying moment loads to the inherently non-symmetric primary C-frame (10) that is fixed to the ground. Thus, in this embodiment, the insertion device support to the ground does not distort differently when magnetic attraction varies with gap change and therefore the horizontal and vertical midplanes of the magnetic field remain aligned to the particle beam.

The secondary C-frame (80) might be external to the primary C-frame (10) as shown in FIG. 5, in other words mounted on the sides of the primary frame. In an alternative embodiment (not shown in FIG. 5), the secondary C-frame is located in an opening or openings between the main frame (10) vertical ways (20), in other words mounted through the middle of the primary frame. Since an important consideration for the optimal performance of the insertion device, besides geometric misalignment of the girders (40) is deflection of the girders (40) themselves, an optimum longitudinal positioning of the two or more C-shapes constituting the secondary C-frame can be calculated by beam theory or finite element analysis. The optimum location is estimated to be approximately 22% and is indicated by the reference numeral 160 on FIG. 3, indicating the portion of magnet array length from each end of the array to the gap drive attachment (150), in the case where the secondary C-frame (80) consists of two C-shaped elements.

In certain embodiments of the present invention, the stiffness of the secondary C-frame (80) is purposefully adjusted so its deformation constitutes one or more stages of the progressive compensation spring system. To the extent that the progressive compensation spring force/deflection curve matches the magnetic force/gap change curve, symmetry of the secondary C-frame (80) about the particle beam (30) horizontal plane prevents misalignments type c, e, f, i, and l.

The symmetry of both the primary (10) and secondary (80) C-frames around a plane perpendicular to the particle beam (30) and located longitudinally on the center of the magnet arrays (50) controls girder (40) misalignments of type a, d, g, h, j, and k. The gap drive control system (not shown), which can adjust the height of the horizontal girders (40) and thus control the size of the gap (70) between the magnet arrays (50), controls misalignment type b. Additionally, the embodiments of the current invention with secondary C-frames (80) mounted to the primary frame (10) at the particle beam (30) elevation, further prevents misalignments type c, e, f, i, and l, all of which the current art is only capable to ameliorate with additional stiffness. As a result, embodiments of the present invention provide significantly improved planar insertion devices with improved geometrical positioning accuracy of magnet arrays (50) upon variation of the magnet gap (70).

Figure 6:
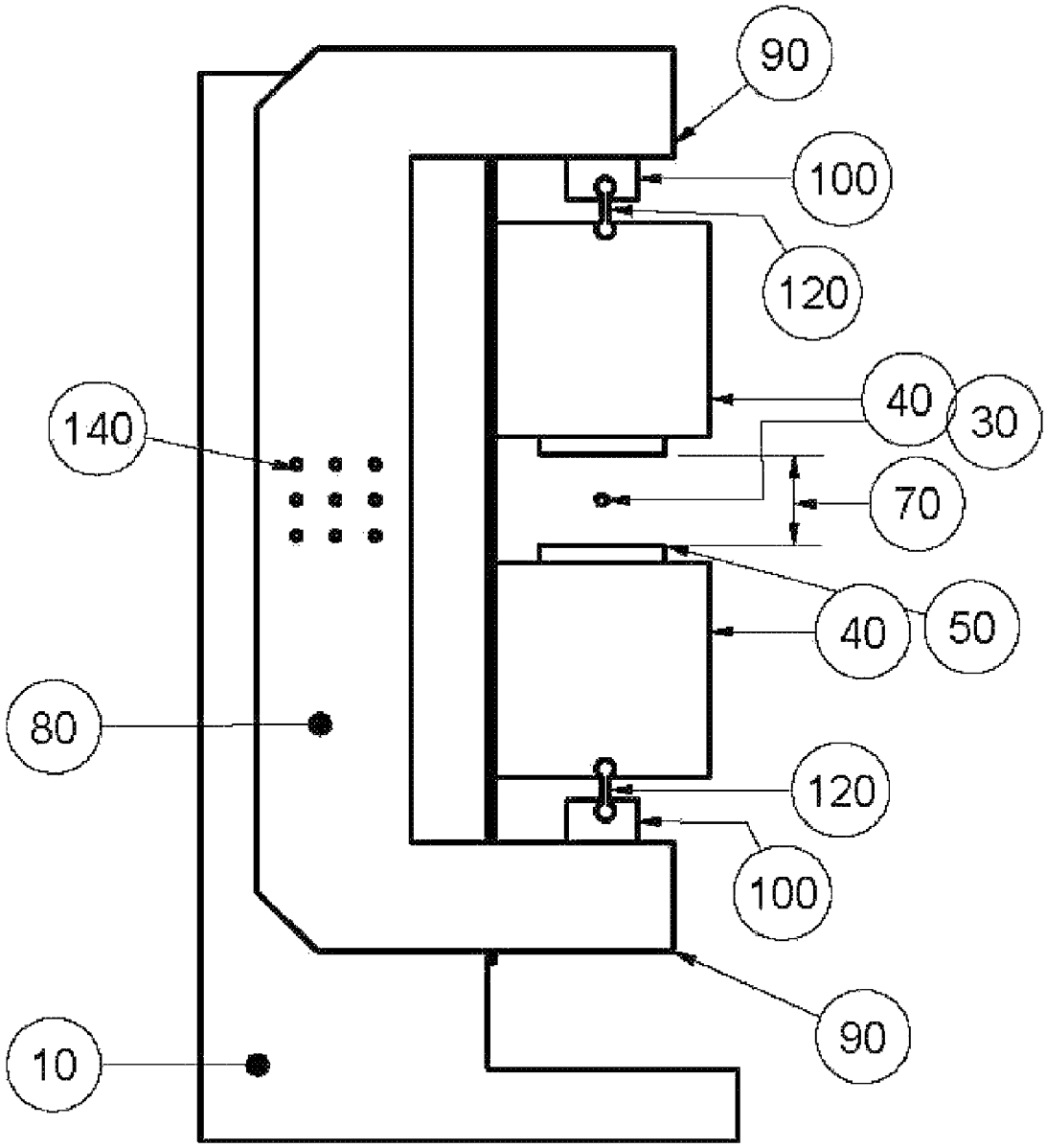
FIG. 6 shows an embodiment of the present invention.

Referring now to FIG. 6, an embodiment of the present invention is shown. In this embodiment, there is a rigid fixation of the secondary C-frame (80) to the primary C-frame (10), with the rigid fixation exemplified by an array of bolts (140), which is positioned at the height of the magnetic mid-plane, with clearance at all other points, instead of using a horizontally oriented linear rail or way (60) as was shown in FIG. 5. In the embodiment of FIG. 6, a linkage or flexure (120) positioned between girders (40) and spring systems (100), optionally within or in line with the compensation spring systems (100), accommodates horizontal movement of the secondary C-frame tips (90) when the secondary C-frame (80) deflects.

Figure 7:
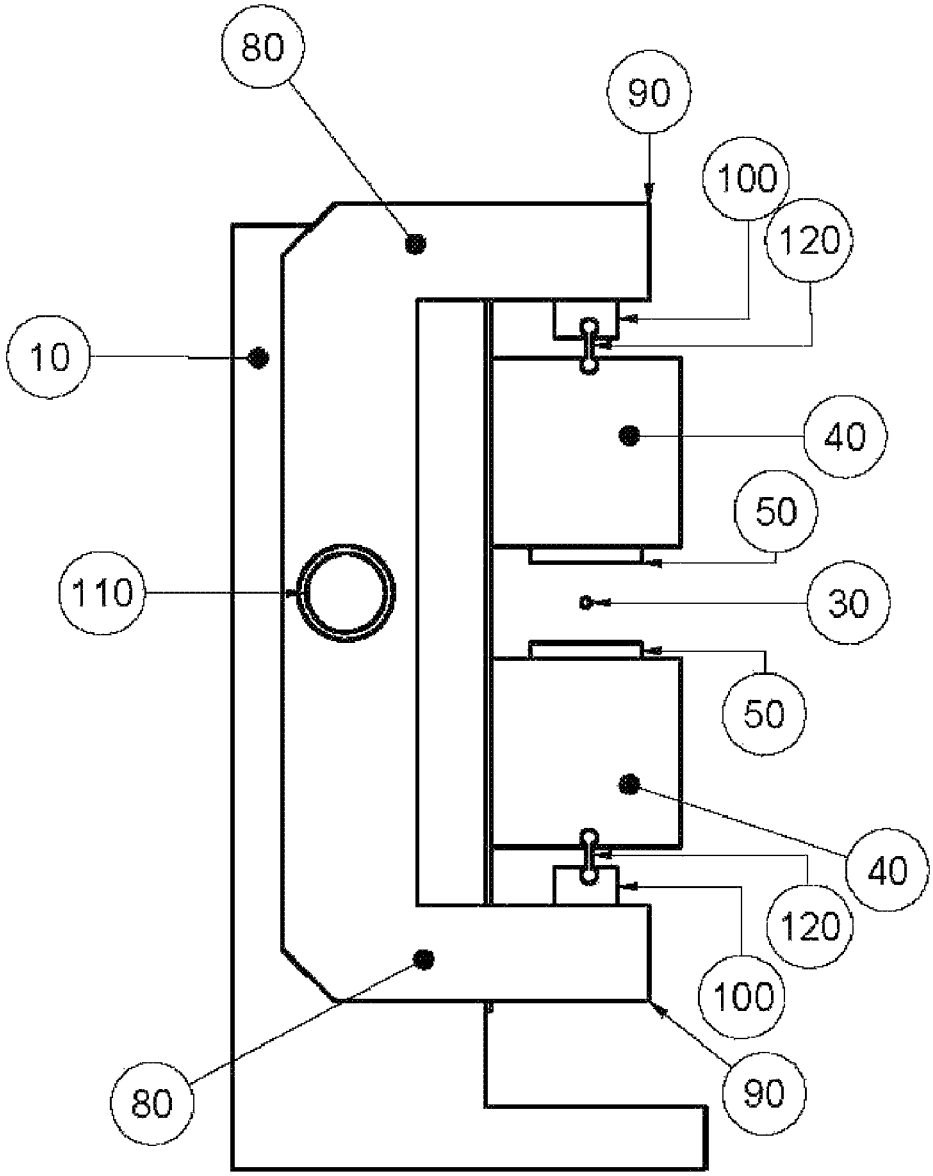
FIG. 7 shows an embodiment of the present invention.

Referring now to FIG. 7, an embodiment of the present invention is shown, with bearings or bushings (110) supporting the secondary C-frame (80), instead of a horizontally oriented linear rail (60) shown in the embodiment of FIG. 5 or rigid fixation (140) shown in the embodiment of FIG. 6. In this embodiment, a link with rotatable attachments at both ends or a flexible link (120) in-line with the compensation spring systems (100) and transmitting the vertical tensile force of magnetic attraction from the girders (40) to the spring assemblies (100) accommodates any horizontal movement of the secondary C-frame tips (90) when the secondary C-frame (80) deflects. The bearing (110) mounting is provided so as to average out manufacturing tolerance differences between upper and lower compensation spring assemblies (100) by allowing the secondary C-frames (80) to freely rotate about its mounting point at the mid-plane of the magnetic field.

Figure 8:
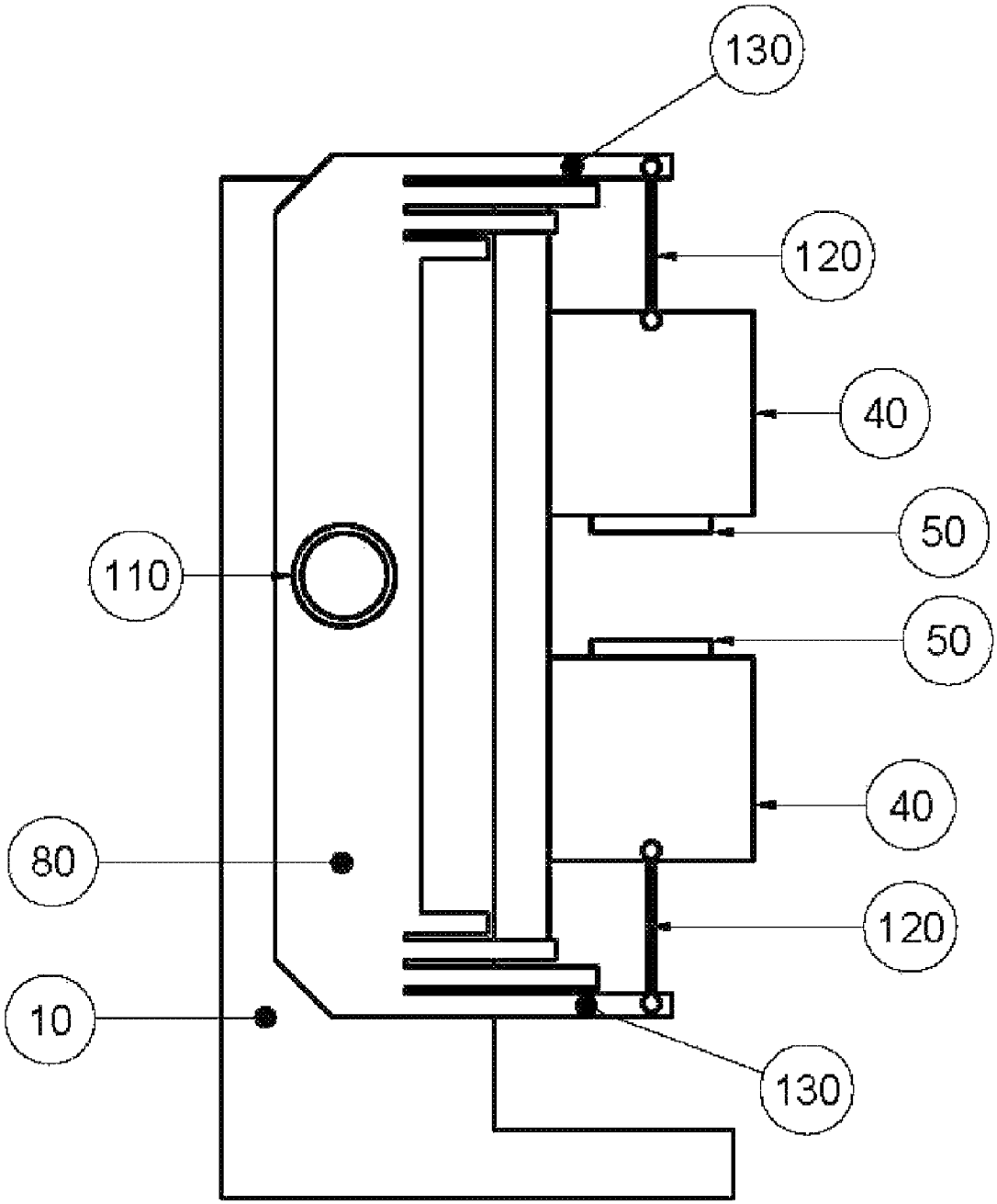
FIG. 8 shows an embodiment of the present invention.
Figure 13:
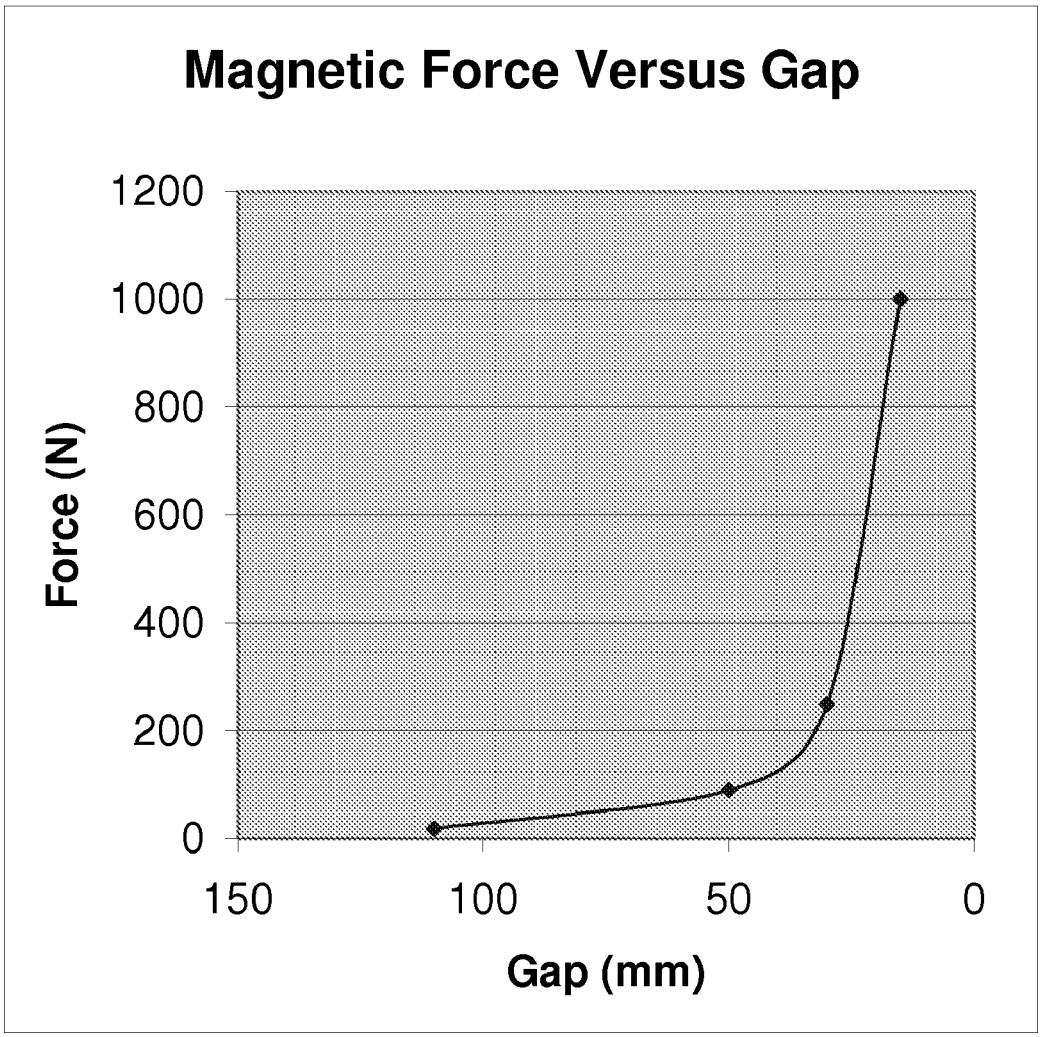
FIG. 13 shows a graph of magnetic force versus the gap of the insertion device magnet array.

Another embodiment of the present invention is shown in FIG. 8, having a secondary C-frame (80) designed to deflect in a progressive fashion closely matching the force vs. magnet array (50) gap (70) curve schematically shown in FIG. 13. The secondary C-frame (80) is designed with leaf springs (130), which are known in the art and used for example in suspensions such as automotive suspensions, or alternatively using progressive spring systems. In this embodiment, the secondary C-frame (80) itself serves the function of the progressive spring assemblies (100). This feature of having upper and lower horizontal arms of the secondary C-frame designed to deflect in a progressive fashion is contemplated for use in any of the herein described embodiments of the present invention, without regard to which type of mounting is employed between the primary C-frame (10) and secondary C-frame (80).

Figure 9:
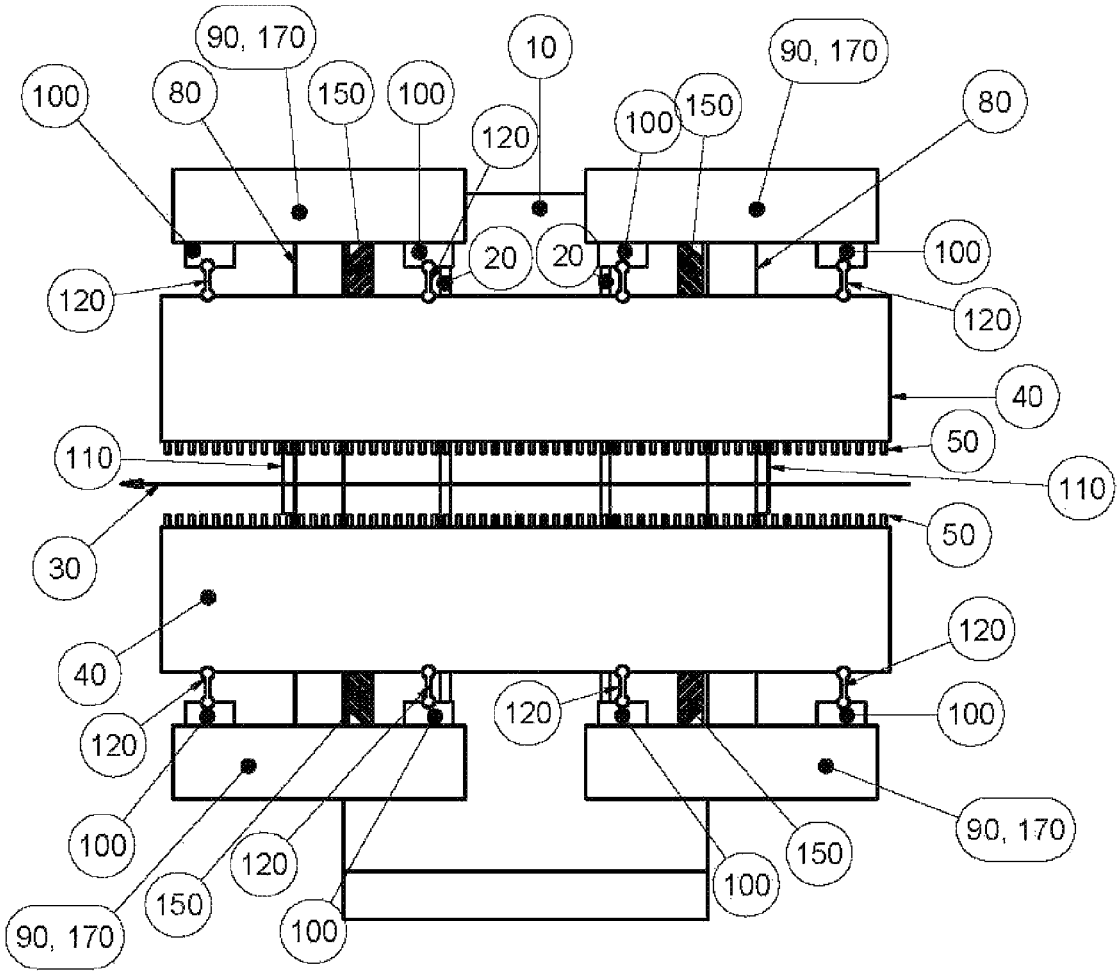
FIG. 9 shows an embodiment of the present invention.

According to another embodiment of the present invention shown in FIG. 9, a secondary C-frame (80) is designed with cross elements (170) at the secondary C-frame tips (90), thus interfacing with twice as many compensation spring assemblies (100) connecting the secondary C-frame (80) to the girders (40), compared to previously described embodiments. As shown in FIG. 9, cross-elements (170) are attached to the tips (90) and each support pairs of compensation springs (100) attached with linkages (120) to girders (40).

In this embodiment, in addition to decreased geometric misalignment of the girders (40), the deflection of the girders (40) themselves is decreased, due to longitudinally positioned higher number of progressive spring assemblies (100), thus more closely matching the evenly distributed magnetic forces which are being compensated, resulting in straighter girders (40) and better linearity of the girder (40) supported magnet arrays (50). Optimization of location of the progressive spring assemblies (100) and the secondary C-frames (80) can be calculated by beam theory or finite element analysis. The force spreading structures of similar type are termed a "wiffle tree". In this embodiment of the present invention, spring assemblies (100) do not compete with gap drive components (150) for optimum location longitudinally along the magnet array (50), but are positioned on either side of the optimum gap drive attachment (150) location resulting in advantages for design and assembly without compromises in the gap drive attachment location. The present embodiment further reduces the undesired deflection of the girders (40) and affixed magnet arrays (50).

Figure 10:
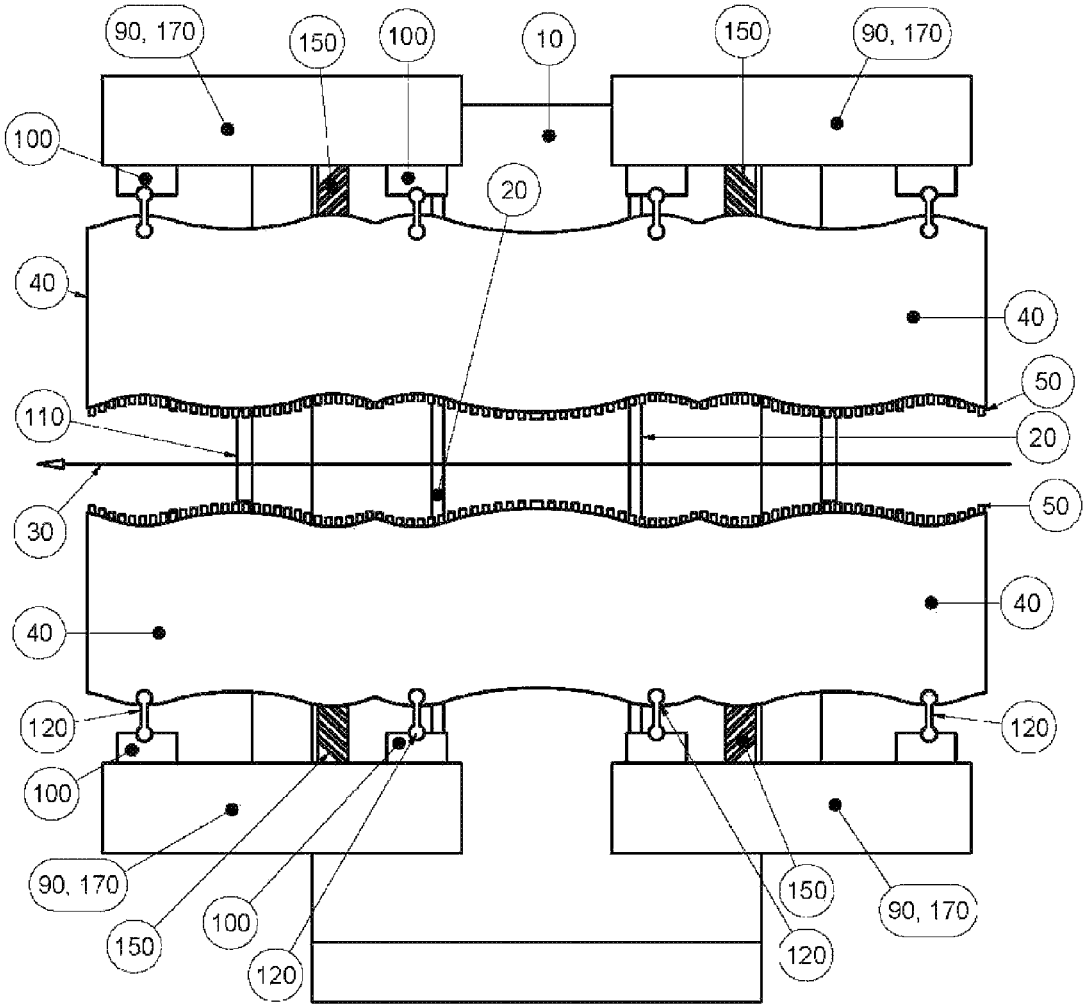
FIG. 10 shows a schematic of the insertion device girder distortion for an embodiment of the present invention.

FIG. 10 illustrates the girder distortion for an insertion device supporting structure embodiment according to the present invention, illustrating improved and decreased girder distortions and misalignments.

Progressive Spring Assembly

Figure 11:
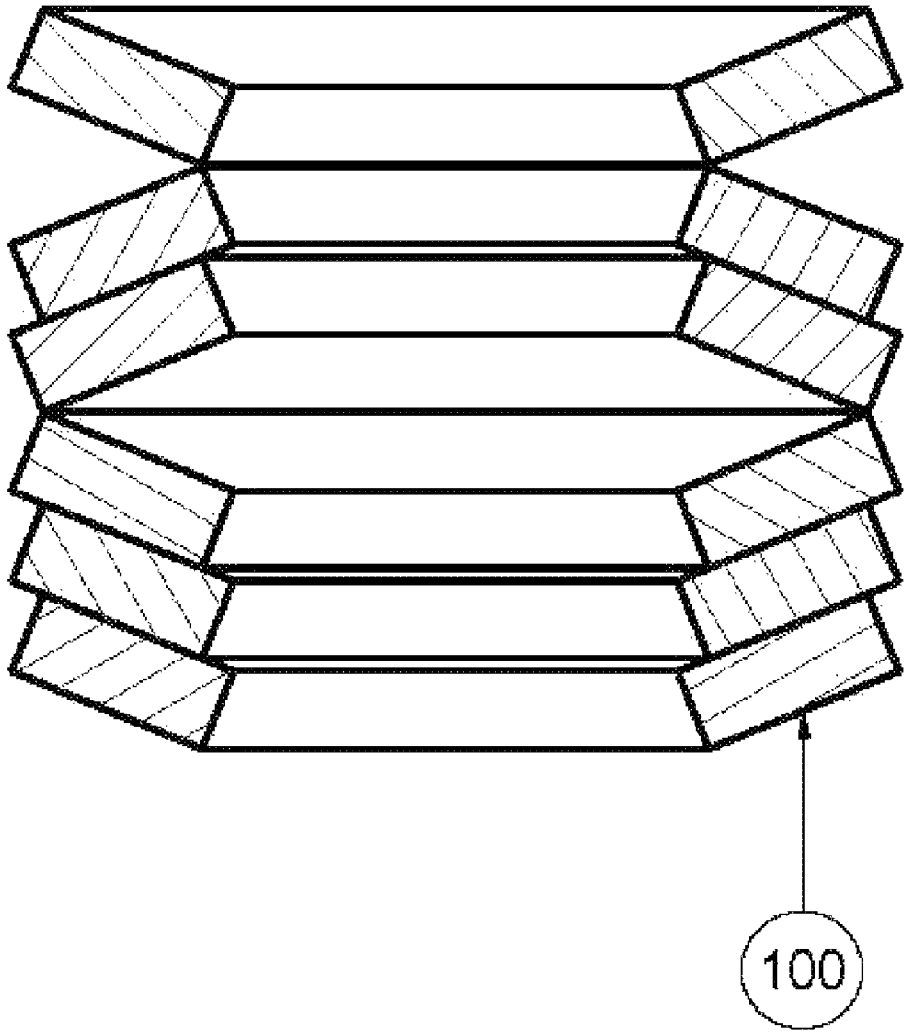
FIG. 11 shows schematics of a progressive spring assembly.
Figure 12:
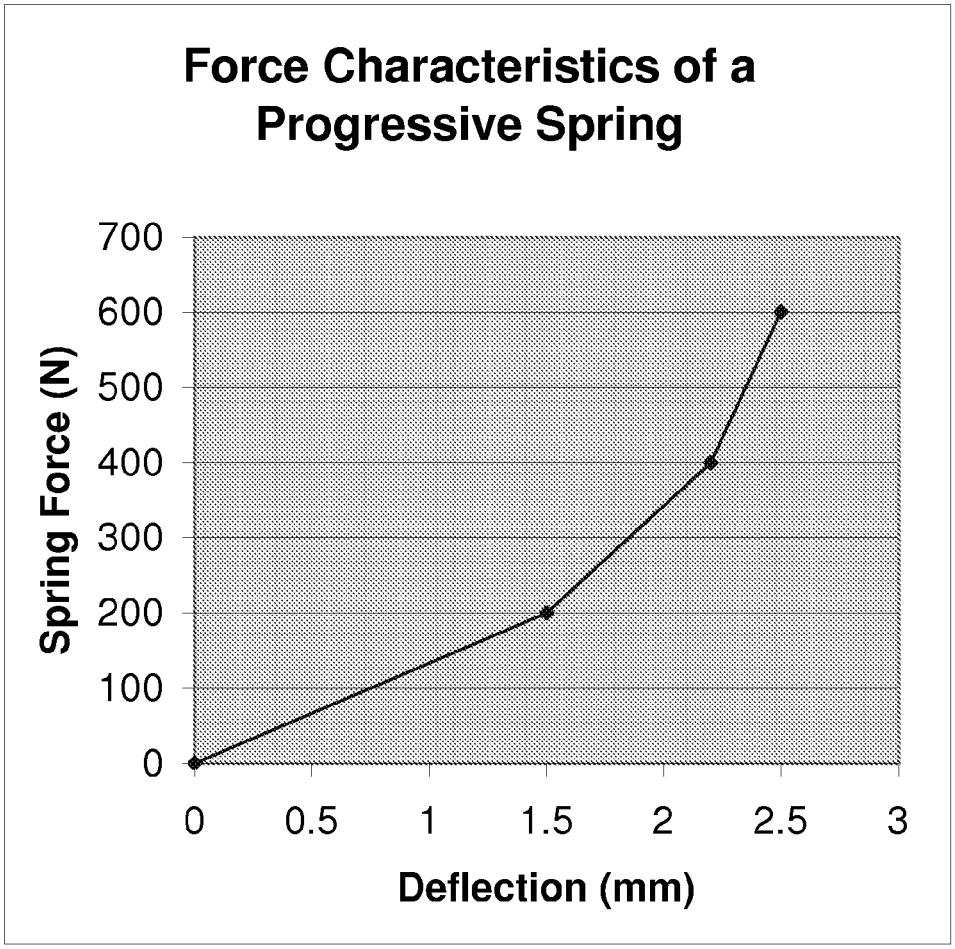
FIG. 12 shows a graph of force characteristics of a progressive spring versus deflection.

Force compensation spring assemblies are known in the art. Design of progressive spring assemblies is described, for example, in Handbook for Disk Springs, Schnorr Corporation, Ann Arbor, Mich., including several methods of obtaining progressive characteristics using disc springs. FIG. 11 shows a schematic of a progressive spring assembly 100, while FIG. 12 shows a graph of spring force vs. deflection.

In certain embodiments of the present invention, progressive spring assemblies (100) are used to produce a countering force to offset the magnetic attractive force at any magnet gap (70) setting. The spring assemblies may be designed with a progressive force/deflection curve to closely match the non-linear magnetic attractive force/gap characteristics of the insertion device's magnet arrays. Referring to FIG. 13, the plot of magnetic force vs. magnet gap (70) shows highly non-linear characteristic curve. The spring assemblies (100) are optimally located directly above and below the particle beam (30) so as to lie on the plane of magnetic attraction symmetry and thereby directly counter the majority of magnetic attraction and transmit the force to the insertion device secondary C-frame (80). Force compensation spring assemblies 100 reduce the load seen by the gap drive components. They reduce the load on vertical linear guidance components as well, and transmit most of the guidance moment load back to the secondary C-frame (80), where it is contained within symmetry to reduce misalignment type i to a value dependent on only the tolerance of matching spring assembly forces to magnetic forces.

What is claimed is:

1. A support structure for a planar insertion device for treating a synchrotron particle beam, comprising:

a primary frame;

a first secondary C-frame and a second secondary C-frame horizontally spaced from each other and mounted on said primary frame, said secondary C-frames having substantially similar geometry, comprising a vertical portion interconnecting a horizontally-extending upper arm and a horizontally-extending lower arm, said arms being vertically spaced;

at least one elongated substantially linear upper girder and at least one elongated substantially linear lower girder, said girders mounted on said secondary C-frames and positioned at least partially between said upper and lower arms, with said upper girder mounted on said upper arm and said lower girder mounted on said lower arm;

said girders forming a gap therebetween and arranged substantially horizontally and parallel to each other and to the synchrotron particle beam;

said girders having a proximal end and a distal end, wherein said proximal ends of said upper girder and said lower girder are mounted on said first secondary C-frame, wherein said distal ends of said upper girder and said lower girder are mounted on said second secondary C-frame, and magnetic arrays rigidly mounted on said upper girder and said lower girder, said magnetic arrays facing each other and facing said gap, with the synchrotron particle beam passing between said magnetic arrays through the gap.

2. A support structure for a planar insertion device according to claim 1 adapted to prevent detrimental deformation reactions to variations of magnetic loadings with changes in said gap and subsequent geometrical misalignments.

3. A support structure for a planar insertion device according to claim 2, wherein said girders are vertically translating girders.

4. A support structure for a planar insertion device according to claim 3, wherein said girders are translating on vertical rails, and wherein a distance from said rails to a closest of said proximal end and said distal end of said girder is approximately 22% of a length of said girder.

5. A support structure for a planar insertion device according to claim 2, wherein said secondary C-frames are moveably mounted to said primary frame at said vertical portion.

6. A support structure for a planar insertion device according to claim 5, wherein said secondary C-frames are mounted to said primary frame on horizontally oriented linear rails at substantially a level of said synchrotron particle beam.

7. A support structure for a planar insertion device according to claim 2, wherein said secondary C-frames are adapted to have free movement transversely to said synchrotron particle beam.

8. A support structure for a planar insertion device according to claim 2, further comprising at least four compensation spring assemblies interposed between said girders and said arms, said compensation spring assemblies serving to mount said upper girder to said upper arm and said lower girder to said lower arm.

9. A support structure for a planar insertion device according to claim 8, further comprising four cross-elements, said cross-elements mounted on each of said upper and lower arms, said cross-elements each supporting a plurality of said compensation spring assemblies, said compensation spring assemblies interconnecting said secondary C-frames and said upper and lower girders.

10. A support structure for a planar insertion device according to claim 9, further comprising linkages interposed between said compensation spring assemblies and said girders.

11. A support structure for a planar insertion device according to claim 2, wherein said secondary C-frames are mounted opposite each other, with first secondary C-frame mounted on a left side of said primary frame, and said second secondary C-frame is mounted on a right side of said primary frame.

12. A support structure for a planar insertion device according to claim 2, wherein said secondary C-frames are mounted side by side on a front side of said primary frame.

13. A support structure for a planar insertion device according to claim 2, wherein said secondary C-frames are rigidly mounted to said primary frame at said vertical portion by a mounting means, said mounting means positioned vertically substantially at a height corresponding to a center of said gap.

14. A support structure for a planar insertion device according to claim 13, wherein a plurality of flexible linkages is interposed between said girders and compensation spring assemblies, said flexible linkages serving to mount said girders to said compensation spring assemblies, wherein said flexible linkages are adapted to accommodate horizontal movement of said secondary C-frames.

15. A support structure for a planar insertion device according to claim 2 wherein said secondary C-frames are rotatably mounted to said primary frame at said vertical portion by a bearing means, said bearing means positioned vertically substantially at a height corresponding to a center of said gap.

16. A support structure for a planar insertion device according to claim 15, wherein a plurality of flexible linkages is interposed between said girders and compensation spring assemblies, said flexible linkages serving to mount said girders to said compensation spring assemblies, wherein said flexible linkages are adapted to accommodate horizontal movement of said secondary C-frames.

17. A support structure for a planar insertion device according to claim 2, wherein said secondary C-frame is adapted to deflect in a progressive fashion responding to changes in a magnetic force with changes in dimensions of said gap.

18. A support structure for a planar insertion device according to claim 17, wherein said upper arm and lower arm are formed to have a plurality of leaf springs.

19. A planar insertion device for treating a synchrotron particle beam, comprising:

a primary frame;

a first secondary C-frame and a second secondary C-frame horizontally spaced from each other and mounted on said primary frame, said secondary C-frames having substantially similar geometry, comprising a vertical portion interconnecting a horizontally-extending upper arm and a horizontally-extending lower arm, said arms being vertically spaced;

at least one elongated substantially linear upper girder and at least one elongated substantially linear lower girder, said girders mounted on said secondary C-frames and positioned at least partially between said upper and lower arms, with said upper girder mounted on said upper arm and said lower girder mounted on said lower arm;

said girders forming a gap therebetween and arranged substantially horizontally and parallel to each other and to the synchrotron particle beam;

said girders having a proximal end and a distal end, wherein said proximal ends of said upper girder and said lower girder are mounted on said first secondary C-frame, wherein said distal ends of said upper girder and said lower girder are mounted on said second secondary C-frame, and magnetic arrays rigidly mounted on said upper girder and said lower girder, said magnetic arrays facing each other and facing said gap, with the synchrotron particle beam passing between said magnetic arrays through the gap.

20. A planar insertion device according to claim 19, further comprising at least four compensation spring assemblies interposed between said girders and said arms, wherein said girders are vertically translating girders, said secondary C-frames are moveably mounted to said primary frame on horizontally oriented linear rails at said vertical portion at substantially a level of the synchrotron particle beam;

said secondary C-frames are adapted to have free movement transversely to said synchrotron particle beam, and said compensation spring assemblies serving to mount said upper girder to said upper arm and said lower girder to said lower arm.

* * * * *